US006677005B2

(12) United States Patent
Kaneko et al.

(10) Patent No.: US 6,677,005 B2
(45) Date of Patent: Jan. 13, 2004

(54) INK-JET RECORDING MATERIAL

(75) Inventors: Satoshi Kaneko, Tokyo (JP); Norimasa Miyachi, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 125 days.

(21) Appl. No.: 09/739,107

(22) Filed: Dec. 19, 2000

(65) Prior Publication Data

US 2001/0004487 A1 Jun. 21, 2001

(30) Foreign Application Priority Data

Dec. 20, 1999 (JP) ..... 11-361028
Dec. 21, 1999 (JP) ..... 11-363001

(51) Int. Cl.[7] ..... B41M 5/00
(52) U.S. Cl. ..... 428/32.25; 428/32.26; 428/32.28; 428/32.36; 428/32.37; 428/32.18

(58) Field of Search ..... 428/195, 206, 428/304.4, 327, 423.1, 447, 500, 32.18, 32.25, 32.26, 32.28, 32.36, 32.37

(56) References Cited

U.S. PATENT DOCUMENTS 4,686,118 A * 8/1987 Arai et al. ..... 427/261
5,576,088 A * 11/1996 Ogawa et al. ..... 428/327
5,846,647 A * 12/1998 Yoshino et al. ..... 428/328
5,916,673 A * 6/1999 Fryberg et al. ..... 428/328
6,358,306 B1 * 3/2002 Hanada et al. ..... 106/287.13

* cited by examiner

*Primary Examiner*—B. Hamilton Hess
*Assistant Examiner*—B. Shewareged
(74) *Attorney, Agent, or Firm*—Paul E. White, Jr.; Manelli Denison & Selter PLLC

(57) ABSTRACT

There is disclosed an ink-jet recording material which comprises a support and a layer containing at least one of a polymer latex and a resin emulsion in combination with solid fine particles, and at least one layer containing fumed silica formed on the above-mentioned layer.

18 Claims, No Drawings

INK-JET RECORDING MATERIAL

BACKGROUND OF THE INVENTION

1. Field of the Invention

This invention relates to an ink-jet recording material, particularly to an ink-jet recording material excellent in ink-absorption capacity, drying property and glossiness after printing.

2. Prior Art

As a recording material to be used for an ink-jet recording system, a recording material which comprises a porous ink-receptive layer comprising a pigment such as amorphous silica, and a hydrophilic binder such as polyvinyl alcohol being provided on a support such as a usual paper or the so-called ink-jet recording sheet has generally been known.

There have been proposed recording sheets obtained by coating a silicon-containing pigment such as silica with a hydrophilic binder onto a paper support as disclosed in, for example, Japanese Provisional Patent Publications No. 51583/1980, No. 157/1981, No. 107879/1982, No. 107880/1982, No. 230787/1984, No. 204390/1985, No. 160277/1987, No. 184879/1987, No. 183382/1987, No. 11877/1989, and the like.

Also, in Japanese Patent Publication No. 56552/1991, Japanese Provisional Patent Publications No. 188287/1990, No. 81064/1998, No. 119423/1998, No. 175365/1998, No. 203006/1998, No. 217601/1998, No. 20300/1999, No. 20306/1999 and No. 34481/1999, U.S. Pat. No. 5,612,281, and EP 0 813 978 A, and the like, there have been disclosed ink-jet recording materials using synthetic silica fine particles prepared by a gas phase process (hereinafter referred to as "fumed silica"). The fumed silica is ultrafine particles having an average particle size of a primary particle of several nm to several tens nm, and has characteristics of giving high gloss and high ink-absorption properties.

On the other hand, a number of recording materials in which an ink-receptive layer mainly comprising a hydrophilic polymer have been proposed. For example, there have been proposed use of polyvinyl alcohol and polyacrylic acid type water-soluble polymer in Japanese Provisional Patent Publication No. 168651/1985; use of hydroxyethyl cellulose in Japanese Provisional Patent Publication No. 262685/1985; use of a mixture of carboxymethyl cellulose and polyethylene oxide in Japanese Provisional Patent Publication No. 181679/1986; use of a mixture of water-soluble cellulose and polyvinyl pyrrolidone in Japanese Provisional Patent Publication No. 193879/1986; use of a receptive layer formed from an aqueous gelatin solution having a specific pH in Japanese Provisional Patent Publication No. 263084/1987; and use of a mixture comprising gelatin and a surfactant in Japanese Provisional Patent Publication No. 146784/1989, respectively.

Also, in recent years, a two-layered structure recording material comprising a porous (void type) ink-receptive layer (a void layer) using the above-mentioned pigments and a swelling type ink-receptive layer (a swelling layer) using a water-soluble polymer has been proposed. For example, a recording material which comprises a swelling layer comprising a water-soluble polymer provided on a void layer comprising silica fine particles or alumina sol, etc. is disclosed in Japanese Provisional Patent Publications No. 51470/1993 and No. 323475/1997; a recording material having a porous ink-receptive layer (a void layer) comprising a hydrophobic polymer provided on an ink-receptive layer (a swelling layer) comprising a water-soluble polymer is disclosed in Japanese Provisional Patent Publications No. 35275/1986 and No. 196175/1987; and a recording material having an ink-receptive layer (a void layer) comprising a pigment provided on an ink-receptive layer (a swelling layer) comprising a water-soluble polymer is disclosed in Japanese Provisional Patent Publications No. 140878/1987, No. 222887/1987, No. 72460/1991, No. 50739/1993, No. 186521/1995, No. 187934/1996, No. 29369/1998 and No. 100397/1998. In Japanese Provisional Patent Publication No. 20066/1997, a recording material having an ink-receptive layer mainly comprising inorganic fine particles provided on an ink-receptive layer mainly comprising a pigment and a binder has been disclosed. Also, an ink-jet recording material having a first ink-receptive layer containing a hydrophilic binder as a lower layer and a second ink-receptive layer containing a fumed silica as an upper layer is disclosed in Japanese Provisional Patent Publications No. 34481/1999, No. 48602/1999 and No. 48603/1999. In the above-mentioned Japanese Provisional Patent Publication No. 48602/1999, there is disclosed that a hydrophilic binder and solid fine particles are contained in the lower layer, and in Japanese Provisional Patent Publication No. 48603/1999, there is disclosed that a polymer latex and a hydrophilic binder are contained in the lower layer.

However, the above-mentioned recording materials are not sufficiently satisfied in the important characteristics such as an ink-absorption capacity, drying properties and glossiness after printing, simultaneously. In particular, a high speed plotter with a large-sized and a large ink amount has been developed in recent years so that the above-mentioned characteristics are becoming more important.

Also, as described above, in the void type ink-receptive layer containing the fumed silica which are ultrafine particles having an average particle size of a primary particle of several nm to several tens nm, high gloss and high ink-absorption properties can be easily obtained. However, since ultrafine particles are used, there is a problem that crack or crazing is easily generated at the time of drying after coating. In particular, crack or crazing is markedly caused when the ink-receptive layer comprises two-layer structure and a layer containing the fumed silica is used as an upper layer.

On the other hand, as a support for the ink-jet recording material, paper has generally been used. In recent years, a recording sheet having characteristics like photography has earnestly been desired. However, a recording sheet using paper as a support has problems of gloss, the feel of a material, water resistance, cockling (wrinkle or surface waviness) after printing, and the like. Thus, a water resistant support such as a plastic resin film including a polyester film, or a resin-laminated paper in which a polyolefin resin such as polyethylene is laminated on the both surfaces of paper has now been used. However, different from a paper support, these water resistant supports cannot absorb ink so that it is important that an ink-receptive layer provided on the support has a high ink absorption property. Accordingly, to prepare a recording sheet using a water resistant support, a much amount of a pigment should be coated on the support as compared with that of a recording sheet using a paper support. When the content of the pigment is increased, surface crack (crazing) is likely caused at the time of drying the ink-receptive layer after coating whereby the quality of the sheet is markedly lowered.

SUMMARY OF THE INVENTION

An object of the present invention is to provide an ink-jet recording material which causes no cracking at an ink-receptive layer, has high ink-absorption capacity, is rapid in drying property after printing and has high gloss. Moreover, another object of the present invention is to provide a photo-like ink-jet recording material using a water resistant support.

The above objects of the present invention can be basically accomplished by an ink-jet recording material which comprises a support, a first layer containing (1) at least one of a polymer latex and a resin emulsion, and (2) solid fine particles provided on the support and at least one second layer containing fumed silica provided on the first layer.

In the present invention, an ink-receptive layer is divided into at least two layers to obtain high ink-absorption capacity and rapid drying properties after printing. That is, an upper layer containing fumed silica rapidly absorbs ink and transmit the ink to a lower layer, and the lower layer comprising at least one of a polymer latex and a resin emulsion, and solid fine particles retains the ink. In the present invention, the present inventors have found that an ink-jet recording material which has high ink-absorption capacity and is capable of preventing occurrence of crack which is a defect of fumed silica can be obtained by making the lower layer comprising at least one of a polymer latex and a resin emulsion layer, as well as solid fine particles. According to this constitution, high gloss and high ink-absorption rate (drying property) which are advantages possessed by the fumed silica can be developed and an ink-jet recording material having a large ink-absorption capacity can be realized.

DESCRIPTION OF THE PREFERRED EMBODIMENTS

In the following, the embodiments of the present invention are explained in detail.

The ink-jet recording material of the present invention has at least two ink-receptive layers, and the ink-receptive layers comprise a layer containing at least one selected from a polymer latex and a resin emulsion, as well as solid fine particles as a lower layer (hereinafter abbreviated to as "a latex-containing layer") and at least one layer containing fumed silica as an upper layer (hereinafter abbreviated to as "a fumed silica-containing layer"). The fumed silica-containing layer is a layer mainly containing fumed silica. The layer mainly containing fumed silica means that the fumed silica is contained in an amount of 50% by weight or more, preferably 60% by weight or more based on the total solid component.

In the ink-jet recording material of the present invention, the fumed silica-containing layer may be provided in two or more layers, or else, a subbing layer may be provided between the latex-containing layer and a support. Also, a protective layer may be provided on the fumed silica-containing layer.

The fumed silica to be used in the present invention is a silica synthesized by the gas phase process. In synthesized silica, there are two types of materials, one (precipitated silica) of which is prepared by the wet process and the other (fumed silica) is prepared by the gas phase process. Usual silica fine particles mean those prepared by the wet process in many cases. As the silica prepared by the wet process, there are (1) a silica sol obtained by metathesis of sodium silicate by an acid or passing through an ion exchange resin layer; (2) a colloidal silica obtained by heating and maturing the silica sol of (1); (3) a silica gel obtained by gelling silica sol in which formation conditions thereof are changed whereby primary particles of a silica gel having a diameter of several microns to 10 microns are agglomerated to form three-dimensional secondary particles; and (4) a synthetic silicic acid compound mainly comprising silicic acid obtained by heating silica sol, sodium silicate, sodium aluminate, etc.

Fumed silica to be used in the present invention is also called to as the drying method contrary to the wet method, and the fumed silica can be generally prepared by a flame hydrolysis method. More specifically, it has been known a method in which silicon tetrachloride is burned with hydrogen and oxygen. In this method, silanes such as methyl trichlorosilane, trichlorosilane, etc., may be used alone in place of silicon tetrachloride or in combination of silicone tetrachloride. The fumed silica is commercially available from Nippon Aerosil K.K. (Japan) under the trade name of Aerosil, and K.K. Tokuyama (Japan) under the trade name of QS type, etc.

In the present invention, it is preferred to use fumed silica having an average primary particle size of 50 nm or less, more preferably 5 to 30 nm. More preferably, those having an average primary particle size of 5 to 15 nm and a specific surface area measured by the BET (Brunauer-Emmett-Teller) method of 200 $m^2/g$ or more (preferably 200 to 500 $m^2/g$) The BET method herein mentioned means one of a method for measuring surface area of powder material by a gas phase adsorption method and is a method of obtaining a total surface area possessed by 1 g of a sample, i.e., a specific surface area, from an adsorption isotherm. As an adsorption gas, a nitrogen gas has frequently been used, and a method of measuring an adsorption amount obtained by the change in pressure or a volume of a gas to be adsorbed has most frequently been used. Most frequently used equation for representing isotherm of polymolecular adsorption is a Brunauer-Emmett-Teller equation which is also called to as a BET equation and has widely been used for determining a surface area of a substance to be examined. A specific surface area can be obtained by measuring an adsorption amount based on the BET equation and multiplying the amount with a surface area occupied by the surface of one adsorbed molecule.

The characteristic feature of the fumed silica resides in that it exists in secondary particles in which primary particles are joined in a network structure or chain-like structure to form flocculate whereby a higher ink-absorption property can be obtained. Also, the primary particle size is extremely small so that high gloss can be maintained even when it is used in the upper layer of the recording material.

The colloidal silica prepared by the wet process has an extremely small primary particle size as several nm to several tens nm, but exists as primary particles each solely. Thus, if a film is formed by using the colloidal silica, particles are present with a dense state so that when it is used as an ink-receptive layer, its gloss is high but a void property is low whereby the ink-absorption property is low. Also, secondary flocculated silica particles prepared by the wet process and having a diameter of several $\mu$m to 10 $\mu$m have high ink-absorption property but its gloss is low. In an alumina sol, desired ink-absorption property cannot be obtained and it requires a high-temperature treatment at 120° C. or so for the purpose of forming a film and providing a water resistant property. Thus, it involves the problems in workability and selection of a support (when a polyethylene resin-coated paper is used, the polyethylene resin layer is melted to cause blisters).

An amount of the fumed silica to be contained in the fumed silica-containing layer is preferably 5 to 20 $g/m^2$, more preferably in the range of 5 to 15 g/m$^2$. By using at least one of a polymer latex and a resin emulsion in combination with solid fine particles in the lower layer, an ink-absorption capacity can be increased even when a much amount of the fumed silica is not contained as in the conventional material.

In the present invention, a hydrophilic binder is preferably contained in the fumed silica-containing layer to maintain the characteristics as a film. As the hydrophilic binder, conventionally known various kinds of binders can be used, and a polyvinyl alcohol or a cationic-modified polyvinyl alcohol is preferably used since they have good binding properties with the fumed silica.

Among the polyvinyl alcohol, particularly preferred is a partially or completely saponified polyvinyl alcohol having a saponification degree of 80% or more. Also, in view of improving film-forming property and film brittleness, those having an average polymerization degree of about 200 to about 5000 are preferably used.

Also, as the cationic-modified polyvinyl alcohol, there may be mentioned, for example, a polyvinyl alcohol having a primary to tertiary amino group or a quaternary ammonium group at the main chain or side chain as disclosed in Japanese Provisional Patent Publication No. 10483/1986.

Moreover, other hydrophilic binder may be used in combination but an amount thereof is preferably 20% by weight or less based on the amount of the polyvinyl alcohol. An amount of the hydrophilic binder to be used in combination with the fumed silica is 50% by weight or less, preferably in the range of 10 to 40% by weight based on the amount of the fumed silica.

Furthermore, it is preferred to contain various kinds of oil droplets in the fumed silica-containing layer to improve brittleness of a film. As such oil droplets, there may be mentioned a hydrophobic high boiling point organic solvent (for example, liquid paraffin, dioctyl phthalate, tricresyl phosphate, silicone oil, etc.) or polymer particles (for example, particles in which at least one of a polymerizable monomer such as styrene, butyl acrylate, divinyl benzene, butyl methacrylate, hydroxyethyl methacrylate, etc. is polymerized) each having a solubility in water at room temperature of 0.01% by weight or less. Such oil droplets can be used in an amount in the range of 10 to 50% by weight based on the amount of the hydrophilic binder.

Moreover, in the fumed silica-containing layer, it is preferred to use, in combination with the hydrophilic binder, a cross-linking agent of said binder. As the cross-linking agent, any of inorganic or organic materials known in the field of photography can be used. Specific examples of the cross-linking agent may include an aldehyde type compound such formaldehyde, glyoxal and glutaraldehyde; a ketone compound such as diacetyl and chloropentadione; bis(2-chloroethyl-urea)-2-hydroxy-4,6-dichloro-1,3,5-triazine, a compound having a reactive halogen as disclosed in U.S. Pat. No. 3,288,775; divinylsulfone; a compound having a reactive olefin as disclosed in U.S. Pat. No. 3,635,718; an methylol compound as disclosed in U.S. Pat. No. 2,732,316; an isocyanate compound as disclosed in U.S. Pat. No. 3,103,437; anaziridine compound as disclosed in U.S. Pat. Nos. 3,017,280 and 2,983,611; a carbodiimide type compound as disclosed in U.S. Pat. No. 3,100,704; an epoxy compound as disclosed in U.S. Pat. No. 3,091,537; a halogen carboxyaldehyde compound such as mucochloric acid, a dioxane derivative such as dihydroxydioxane, an inorganic cross-linking agent such as chromium alum, potassium alum, zirconium sulfate, boric acid and borax, and they may be used singly or in combination of two or more. Particularly when a polyvinyl alcohol is used as a binder, glyoxal, boric acid or borax is preferred. The above-mentioned cross-linking agent may be preferably used in an amount of 0.5% by weight or more, particularly preferably 1 to 40% by weight based on the amount of the hydrophilic binder.

A cationic polymer is preferably added to the fumed silica-containing layer of the present invention. As the cationic polymers to be used in the present invention, there may be preferably mentioned polyethyleneimine, polydiallylamine, polyallylamine, polydialkyldiallylamine, dimethylamine ammonia epichlorohydrin polycondensate, as well as polymers having a primary to tertiary amino group or a quaternary ammonium group as disclosed in Japanese Provisional Patent Publications No. 20696/1984, No. 33176/1984, No. 33177/1984, No. 155088/1984, No. 11389/1985, No. 49990/1985, No. 83882/1985, No. 109894/1985, No. 198493/1987, No. 49478/1988, No. 115780/1988, No. 280681/1988, No. 40371/1989, No. 234268/1994, No. 125411/1995 and No. 193776/1998, etc. A weight average molecular weight (Mw) of these cationic polymers to be used in the present invention is preferably about 5,000 or more, more preferably about 5,000 to about 100,000. These cationic polymers are preferably used in the range of 1 to 10% by weight, more preferably 2 to 7% by weight based on the amount of the fumed silica.

The ink-jet recording material of the present invention has a layer containing at least one of a polymer latex and a resin emulsion in combination with solid fine particles under the above-mentioned fumed silica-containing layer (a side nearer to the support). The polymer latex and the resin emulsion cannot clearly be classified in a wide meaning but the polymer latex is generally produced from a corresponding monomer by an emulsion polymerization, and the resin emulsion is an emulsion in which a polymer obtained by other than the emulsion polymerization is emulsified. In the present invention, they are classified according to the above.

As the polymer latex and the resin emulsion, there may be mentioned aqueous dispersions of various kinds of polymers. For example, there may be mentioned an aqueous dispersion of an acrylic polymer, an olefin polymer, an urethane polymer, an ester polymer, an amide polymer, a vinylidene chloride polymer, an epoxy polymer, and a modified product thereof or a copolymer thereof. Of these, an acrylic polymer, an olefin polymer and an urethane polymer are preferred, and an urethane polymer is particularly preferred. An average particle size of these polymer latex and resin emulsion is suitably about 0.01 to 5.0 $\mu$m, preferably about 0.01 to 1.0 $\mu$m, more preferably about 0.05 to 0.5 $\mu$m.

As the acrylic polymer, there may be mentioned a homopolymer or copolymer of a monomer(s) such as an acrylate or methacrylate (for example, alkyl, aryl, aralkyl or hydroxyalkyl ester of an acrylic acid or a methacrylic acid), acrylonitrile, acrylamide, acrylic acid or methacrylic acid; or a copolymer of the above-mentioned monomer and at least one of styrene sulfonic acid, vinyl sulfonic acid, itaconic acid, maleic acid, fumaric acid, maleic anhydride, vinyl isocyanate, allyl isocyanate, vinyl methyl ether, vinyl acetate, styrene, divinyl benzene, etc.

As the olefin polymer, a polymer comprising a copolymer of a vinyl monomer and a diolefin is preferred. As the vinyl monomer, styrene, acrylonitrile, methacrylonitrile, methyl acrylate, methyl methacrylate, vinyl acetate, etc. are preferable used, and as the diolefin, butadiene, isoprene, chloroprene, etc. are preferably used.

An urethane resin as the urethane polymer is a synthetic polymer having an urethane bond (—NHCOO—) in the main chain. The polyurethane resins are commercially available from many manufacturers and a number of patents are disclosed. For example, there may be mentioned Pearl Gum (trade name) available from Seiko Kagaku K.K., Japan, Fine Tex, Bondic, Hydran HW, Pateracol IJ series (all trade names) available from Dainippon Ink Chemical Industries, K.K., Japan, F-8000 (trade name) available from Daiichi Kogyo Yakuhin K.K., Japan, Takerak W (trade name) available from Takeda Yakuhin Kogyo K.K., Japan, Permarine (trade name) available from Sanyo Kasei Gokyo K.K., Japan, and Inplarail (trade name) available from Bayer AG, Germany, etc., and as patent publications, polyurethane resins disclosed in Japanese Provisional Patent Publications No. 104160/1997, No. 86505/1998, No. 181189/1998, No. 182962/1998, No. 226985/1998, No. 216945/1999, No. 254809/1999, etc. maybe mentioned.

The polyurethane resin to be used in the present invention is more specifically an addition adduct polymer of a polyisocyanate compound and a polyol having two or more hydroxyl groups. As the polyisocyanate which is available for formation of the polyurethane, there may be mentioned 1,2-diisocyanate ethane, 1,3-diisocyanate propane, tetramethylene diisocyanate, pentamethylene diisocyanate, hexamethylene diisocyanate, dodecamethylene diisocyanate, 1,3-cyclohexylene diisocyanate, 2,4-tolylene diisocyanate, 2,6-tolylene diisocyanate, m-phenylene diisocyanate, p-phenylene diisocyanate, 4,4-diphenylmethane diisocyanate, 2,4-diphenylmethane diisocyanate, 2,2-diphenylmethane diisocyanate, 1,5-naphthalene diisocyanate, etc.

Also, as a suitable polyol having two or more hydroxyl groups, there may be mentioned a diol such as ethylene glycol, diethylene glycol, triethylene glycol, propylene glycol, etc.; a triol such as trimethylolpropane, triethanol amine, hexane triol, glycerin, etc.; a hexaol such as mannitol, sorbitol, etc.; polyester polyol, polyether polyol, polyester polyether polyol, etc. Also, polycarbonate polyol may be used, and such a compound may include those obtained by the reaction of a glycol such as 1,4-butanediol, 1,6-hexanediol, diethylene glycol, etc., with diphenylcarbonate and phosgene.

As the polyurethane resin to be used in the present invention, an aqueous emulsion of a polyurethane resin into which a functional group including an anionic group such as a sulfo group or a carboxyl group, a nonionic group such as an alkyleneoxy group, or a cationic group such as a quaternary ammonium group is/are incorporated is preferred. A nonionic or cationic polyurethane resin emulsion is particularly preferred. An aqueous emulsion of a cationic polyurethane resin is more preferred. As the cationic polyurethane, there may be mentioned, for example, a resin which is made cationic by incorporating a quaternary ammonium group into a molecular chain of the urethane resin. They are disclosed in, for example, Japanese Provisional Patent Publications No. 86505/1988, No. 20304/1999, etc.

Also, a polyurethane resin containing polyalkylene oxide disclosed in Japanese Provisional Patent Publication No. 182962/1998 is preferably used.

Also, in the present invention, hollow particles can be used as a polymer latex. The hollow particles are polymer particles comprising a thermoplastic resin such as a styrene-acrylic acid copolymer, a styrene-methacrylic acid copolymer, a styrene-butadiene copolymer, a polystyrene, a polyester, etc., and singly or a plural number of independent void(s) or connected voids is/are present at the inside of the particles. Also, so-called hollow particles having hole(s) in which a hole(s) is/are present at the particle wall which connects the inside void(s) (hollow portion) and outside the particles. An average particle size of the hollow particles to be used in the present invention is suitably about 0.01 to 1.0 $\mu$m, more preferably about 0.05 to 0.5 $\mu$m. More specifically, particles as disclosed in Japanese Provisional Patent Publications No. 1704/1989, No. 26724/1991, No. 286296/1994, No. 137432/1995, No. 137433/1995, No. 276785/1995, etc.

Of these hollow particles as mentioned above, hollow particles having cationic group are preferred. As cationic group, a quaternary ammonium group, a primary to tertiary amine group is/are introduced into the hollow particles.

A content of the polymer latex and/or resin emulsion in total is suitably about 1 to 10 g/m$^2$, preferably about 1 to 7 g/m$^2$.

As the solid fine particles to be used in the latex-containing layer, inorganic and organic fine particles may be mentioned. As the inorganic fine particles, there may be mentioned, for example, calcium carbonate, magnesium carbonate, kaolin, talc, silica, etc., and as the organic fine particles, there may be mentioned polystyrene, polyacrylate, polymethacrylate, polyethylene, polypropylene, urea resin, melamine resin, etc. Of these, inorganic particles are preferred, particularly preferred are particles having an average particle size of about 0.1 $\mu$m or less. More preferred is the above-mentioned fumed silica. Among the fumed silica, those having an average primary particle diameter of 5 to 30 nm are particularly preferred. By using the fumed silica as the solid fine particles in the lower layer, it is advantageous for gloss, ink-absorption properties and preventing crack.

A content of the solid fine particles in the lower layer is preferably about 10 to 400% by weight, particularly preferably 30 to 300% by weight based on the amount of the polymer latex and/or resin emulsion in total.

Moreover, the above-mentioned cationic polymer is preferably used in the lower layer. An added amount thereof is suitably in the range of 0.1 to 3 g/m$^2$.

Also, a hydrophilic binder may be contained in the lower layer in an amount of 50% by weight or less based on the amount of the polymer latex, preferably 30% by weight or less. The hydrophilic binder may not be contained. If the ratio of the hydrophilic binder is increased, crack at the upper layer containing the fumed silica is likely caused and ink-absorption properties are also lowered.

In the present invention, a surfactant may be contained in the constituent layers such as the fumed silica-containing layer and the latex-containing layer, etc. As the surfactant to be used, a cationic, nonionic or betain type surfactant is preferably used.

To the constituent layers, various kinds of conventionally known additives such as a coloring dye, a coloring pigment, a fixing agent of an ink dye, an UV absorber, an antioxidant, a dispersant of the pigment, an antifoaming agent, a leveling agent, an antiseptic agent, a fluorescent brightener, a viscosity stabilizer, a pH controller, etc. may be added. In the present invention, the latex-containing layer and the fumed silica-containing layer may be subjected to simultaneous multi-layer coating, or after coating the latex-containing layer, the fumed silica-containing layer may be coated, and then, dried. As the coating method at that time, it is not particularly limited, and a coating method conventionally known in the art may be used. For example, there may be mentioned a slide bead system, a curtain system, an extrusion system, an air knife system, a roll coating system, a rod bar coating system, a bar coating system, a dip coating system, etc. In the present invention, a multi-layer simultaneous coating method is preferably used. By subjecting to simultaneous multi-layer coating, gloss is markedly increased as compared with the stepwise coating of the respective layers.

A support to be used in the present invention may be either water-absorptive or water resistant, but a water resistant support is preferred to obtain a photo-like ink-jet recording material.

As the water resistant support to be used in the present invention, a transparent support and an opaque support may be used. As the transparent support, any of those conventionally known in the art may be used. For example, there may be mentioned a plastic resin film such as a polyester resin, a diacetate resin, a triacetate resin, an acryl resin, a polycarbonate resin, a polyvinyl chloride, a polyimide resin, cellophane, celluloid, etc., or a glass plate, and the like. Of these, a film comprising a polyethylene terephthalate is preferably used.

As an opaque water resistant support, any of those conventionally known in the art such as a synthetic paper, a resin-coated paper, an opaque film containing a pigment, a foamed film, etc. can be used. It is preferred to use a resin-coated paper which has been used as a support for photography in the points of gloss, smoothness, hand feeling and high quality appearance.

A base paper constituting the resin-coated paper is not particularly limited, and any paper generally used may be employed. More preferably a smooth base paper such as that used as paper for a photographic support may be used. As pulp for constituting the base paper, natural pulp, regenerated pulp, synthetic pulp, etc. may be used singly or in combination of two or more. In the base paper, various additives conventionally used in the paper making industry such as a sizing agent, a strengthening additive of paper, a loading material, an antistatic agent, a fluorescent brightener, a dye, etc. may be formulated.

Moreover, a surface sizing agent, a surface strengthening additive of paper, a fluorescent brightener, an antistatic agent, a dye, an anchoring agent, etc. may be coated on the surface of the sheet.

A thickness of the base paper is not particularly limited, and preferably that having a good surface smoothness prepared by compressing paper during paper-making or after paper-making by applying pressure using a calender, etc. A basis weight thereof is preferably 30 to 250 g/m$^2$.

As a resin of the resin-coated paper, a polyolefin resin or a resin which cures by irradiation of electron rays may be used. The polyolefin resin may include a homopolymer of an olefin such as low density polyethylene, high density polyethylene, polypropylene, polybutene, polypentene, etc.; a copolymer comprising two or more olefins such as an ethylene-propylene copolymer, etc.; or a mixture thereof, and these polymers having various densities and melt viscosity indexes (melt index) may be used singly or in combination of two or more.

Also, to the resin of the polyolefin resin-coated paper, various kinds of additives including a white pigment such as titanium oxide, zinc oxide, talc, calcium carbonate, etc.; an aliphatic amide such as stearic amide, arachidamide, etc.; an aliphatic metal salt such as zinc stearate, calcium stearate, aluminum stearate, magnesium stearate, etc.; an antioxidant such as Irganox 1010, Irganox 1076 (both trade names, available from Ciba Geigy AG), etc.; a blue-color pigment or dye such as cobalt blue, ultramarine blue, cecilian blue, phthalocyanine blue, etc,; a magenta-color pigment or dye such as cobalt violet, fast violet, manganese violet, etc.; a fluorescent brightener, an UV absorber, etc. may be preferably added optionally combining two or more.

The polyolefin resin-coated paper can be prepared, in the case of using a polyolefin resin, by casting a melted resin under heating on a running base paper, which is so-called the extrusion coating method, whereby the both surfaces of the base paper are coated by the resin. In the case of using a resin which cures by irradiation of electronic rays, the resin is coated on a base paper by means of a coater conventionally used such as a gravure coater, a blade coater, etc., then, electronic rays are irradiated to the resin whereby coating the base paper with the resin. Also, it is preferred to subject an activation treatment to a base paper before coating the resin to the base paper, such as a corona discharge treatment, a flame treatment, etc. The surface (the front surface) on which an ink-receptive layer is to be coated of the support is a gloss surface or a matte surface depending on the purposes, and particularly, a gloss surface is predominantly used. It is not necessarily subjected to resin coating at the back surface of the base paper, but in view of preventing curl, it is preferred to coat the surface of the base paper with the resin. The back surface is usually a non-gloss surface, and if necessary, the activation treatment such as the corona discharge treatment, the flame treatment, etc. may be applied to the front surface or to the both surfaces of the front and back surfaces. Also, a thickness of the resin layer is not particularly limited, and is generally in the range of 5 to 50 $\mu$m on the front surface or both of the front and back surfaces.

Of these resin-coated papers, a polyethylene resin-coated paper is particularly preferred.

To the support of the present invention, various kinds of back coating layer(s) may be provided for the purpose of providing antistatic property, conveying property, anticurl property, etc. to the support. In the back coating layer, an inorganic antistatic agent, an organic antistatic agent, a hydrophilic binder, a latex, a curing agent, a pigment, a surfactant, etc. may be included in optional combination.

EXAMPLES

In the following, the present invention is explained in more detail by referring to Examples, but the present invention is not limited by these Examples.

Example 1

On the front surface of a base paper comprising a pulp formulation of LBKP (50 parts) and LBSP (50 parts) with 120 g/m$^2$ as a support was coated a resin composition comprising a low density polyethylene (70 parts), a high density polyethylene (20 parts) and titanium oxide (10 parts) in an amount of 25 g/m$^2$, and a resin composition comprising a high density polyethylene (50 parts) and a low density polyethylene (50 parts) was coated on the back surface of the same in an amount of 25 g/m$^2$ to prepare a polyolefin resin coated paper.

On the above-mentioned support were simultaneously double-layer coated the following lower layer and the upper layer by the slide bead coating system and dried to prepare various kinds of ink-jet recording sheets. The coating solution for the lower layer is so adjusted that the concentration of the polymer becomes 8% by weight, and the coating solution for the upper layer is so adjusted that the concentration of the silica fine particles becomes 10% by weight.

<Lower Layer>

Polymer latex, resin emulsion or water-soluble polymer 2 g/m$^2$

Solid fine particles (Fumed silica having an average primary particle size of 7 nm, aerosil available from Nippon Aerosil K.K., Japan) X g/m$^2$ Cationic polymer (Dimethylamine ammonia epichlorohydrin polycondensate, Papiogen P-105, trade name, available from K.K. Senka, Japan) 1 g/m$^2$ Amphoteric surfactant (SWAM AM-2150, trade name, available from Nippon Surfactant, Japan) 0.2 g/m$^2$ <Upper Layer>

Silica fine particles 10 g/m$^2$

Cationic polymer (Dimethyldiallyl ammonium chloride homopolymer, Sharol DC902P, trade name, available from Daiichi Kogyo Seiyaku K.K., Japan) 0.4 g/m$^2$ Polyvinyl alcohol (Saponification degree: 88%, average polymerization degree: 3500) 3 g/m$^2$ Boric acid 0.6 g/m$^2$ Amphoteric surfactant (SWAM AM-2150, trade name, available from Nippon Surfactant, Japan) 0.2 g/m$^2$ By changing an amount of the solid particles (X g/m$^2$), and the kind of the polymer latex, resin emulsion and water-soluble polymer in the lower layer and the kind of the silica fine particles in the upper layer as shown in Table 1, various kinds of ink-jet recording sheets were prepared.

TABLE 1

| | Lower layer | | | |
|---|---|---|---|---|
| Recording sheet | Polymer latex, resin emulsion or water-soluble polymer | Content of solid fine particles (X g/m$^2$) | Upper layer Silica fine particles | Remarks |
| 1 | PVA | 3 | Fumed silica | Comparative |
| 2 | Gelatin | 3 | Fumed silica | Comparative |
| 3 | Polymer latex | 0 | Fumed silica | Comparative |
| 4 | Polymer latex | 3 | Fumed silica | This invention |
| 5 | Resin emulsion 1 | 3 | Fumed silica | This invention |
| 6 | Resin emulsion 2 | 3 | Fumed silica | This invention |
| 7 | Resin emulsion 1 | 3 | Wet type colloidal silica | Comparative |
| 8 | Resin emulsion 1 | 3 | Wet type silica | Comparative |

In the table, the following were used.

PVA: polyvinyl alcohol: saponification degree: 88%, average polymerization degree: 3500

Polymer latex: polyacrylate latex: styrene/glycidyl methacrylate/butyl acrylate (20/40/40)

Resin emulsion 1: cationic polyurethane resin emulsion (Pateracol IJ21, trade name, available from Dainippon Ink Kagaku Kogyo, K.K., Japan)

Resin emulsion 2: nonionic polyurethane resin emulsion (Hydran HW, trade name, available from Dainippon Ink Kagaku Kogyo, K.K., Japan)

Fumed silica: average primary particle size: 7 nm, specific surface area: 300 m$^2$/g, Aerosil available from Nippon Aerosil K.K., Japan Wet type colloidal silica: average primary particle size: 10 to 15 nm Wet type silica: average particle size: 2 $\mu$m Further, as comparative examples, Recording sheets were prepared by providing the lower layer and the upper layer of Recording sheet 5 conversely (Recording sheet 9), making a coated amount of the upper layer containing fumed silica double as a single layer of the upper layer alone (Recording sheet 10) and making a coated amount of the lower layer containing the polyurethane resin emulsion 1 triple as a single layer of the lower layer alone (Recording sheet 11). By using these eleven kinds of Recording sheets, ink-absorption capacity, drying property, and glossiness were measured according to the following methods by using a plotter (Novajet-PRO42e, trade name, manufactured by ENCAD Co., GS ink (trade name)). The results are shown in Table 2.

<Ink-Absorption Capacity>

The state of overflow of ink when printing was carried out by a mixed color of Y (yellow), M (magenta), C (cyan) and K (black) was observed with naked eyes and evaluated by the following standards.

◎: There is no overflow even when printing was carried out with 100% of the respective colors (total 400%).

○: Whereas there is slightly overflowed by printing with the total of 400% but no problem by printing with the total of 300%.

Δ: Slightly overflowed by printing with the total of 300%.

X: Significantly overflowed by printing with the total of 300%.

<Drying Property>

Printing was carried out under the above-mentioned conditions (printing with the total of 300%) and after passing a certain period of time, a normal paper was laminated to the printed paper and allowed to stand. A time until when the ink is not transferred to the normal paper was measured and evaluated by the following standards.

◎: Within 2 minutes.

○: 2 to 4 minutes.

Δ: 4 to 6 minutes.

X: 6 minutes or longer.

<Glossiness>

Gloss of the surface of the ink-jet recording sheets which is not yet printed was measured with naked eyes and judged by the following standards.

○: Gloss is extremely high and good.

Δ: Gloss is slightly inferior.

X: Gloss is low.

<Crazing>

Coated surface was observed with naked eyes and the state of crazing was judged with naked eyes and evaluated by the following three ranks.

○: No crazing was observed.

Δ: Crazing was slightly admitted.

X: Crazing was clearly admitted.

TABLE 2

| Recording sheet | Ink absorption capacity | Drying property | Gloss | Crazing | Remarks |
|---|---|---|---|---|---|
| 1 | Δ | ○ | Δ | X | Comparative |
| 2 | Δ | ○ | Δ | X | Comparative |
| 3 | Δ | ○ | Δ | X | Comparative |
| 4 | ○ | ◎ | ○ | ○ | This invention |
| 5 | ◎ | ◎ | ○ | ○ | This invention |
| 6 | ○ | ◎ | ○ | ○ | This invention |

TABLE 2-continued

| Recording sheet | Ink absorption capacity | Drying property | Gloss | Crazing | Remarks |
|---|---|---|---|---|---|
| 7 | X | X | ○ | ○ | Comparative |
| 8 | ○ | ○ | X | ○ | Comparative |
| 9 | Δ | X | ○ | ○ | Comparative |
| 10 | Δ | ○ | ○ | X | Comparative |
| 11 | ○ | X | Δ | ○ | Comparative |

The recording sheets of the present invention satisfy various properties of ink-absorption capacity, drying property and glossiness simultaneously and there is no occurrence of crack which is the problem of fumed silica.

Example 2

By using the same support as in Example 1, the following upper layer and the lower layer were simultaneously double-layer coated by the slide bead coating system and dried to prepare Recording sheet 12.

<Lower Layer>

Polyvinyl alcohol (Saponification degree: 88%, average polymerization degree: 3500) 2 g/m$^2$ Hollow particles (cation-modified acrylic acid-styrene copolymer, average particle size: 0.2 $\mu$m) 3 g/m$^2$ Fumed silica (Average primary particle size: 7 nm, specific surface area: 300 m$^2$/g, aerosil available from Nippon Aerosil K.K., Japan) 2.5 g/m$^2$ Cationic polymer (Dimethylamine ammonia epichlorohydrin polycondensate, Papiogen P-105, trade name, available from K.K. Senka, Japan) 1 g/m$^2$ Amphoteric surfactant (SWAM AM-2150, trade name, available from Nippon Surfactant, Japan) 0.2 g/m$^2$ <Upper Layer>

Fumed silica (Average primary particle size: 7 nm, specific surface area: 300 m$^2$/g, aerosil available from Nippon Aerosil K.K., Japan) 10 g/m$^2$ Cationic polymer (Dimethyldiallyl ammonium chloride homopolymer, Sharol DC902P, trade name, available from Daiichi Kogyo Seiyaku K.K., Japan) 0.4 g/m$^2$ Polyvinyl alcohol (Saponification degree: 88%, average polymerization degree: 3500) 2 g/m$^2$ Boric acid 0.6 g/m$^2$ Amphoteric surfactant (SWAM AM-2150, trade name, available from Nippon Surfactant, Japan) 0.2 g/m$^2$ With regard to Recording sheet 12, the same evaluation was carried out as in Example 1 and as a result, excellent results can be obtained as in the present invention of Example 1.

What is claimed is:

1. An ink-jet recording material comprising a support, a layer containing at least one of a polymer latex and a resin emulsion, and solid particles provided on the support, and at least one layer mainly containing fumed silica provided on the above-mentioned layer.

2. The ink-jet recording material according to claim 1, wherein said fumed silica has an average primary particle size of 5 to 30 nm.

3. The ink-jet recording material according to claim 1, wherein the fumed silica has an average primary particle size of 5 to 15 nm and a specific surface area measured by the BET method of 200 m$^2$/g or more.

4. The ink-jet recording material according to claim 1, wherein the solid particles are fumed silica.

5. The ink-jet recording material according to claim 1, wherein the solid particles are contained in an amount of 30 to 300% by weight based on the amount of at least one of the polymer latex and the resin emulsion in total.

6. The ink-jet recording material according to claim 1, wherein the resin emulsion is a polyurethane resin.

7. The ink-jet recording material according to claim 6, wherein the polyurethane resin is a nonionic or cationic resin.

8. The ink-jet recording material according to claim 1, wherein the polymer latex is hollow particles.

9. The ink-jet recording material according to claim 1, wherein the layer containing at least one of the polymer latex and the resin emulsion layer, and the solid particles further contains a cationic polymer.

10. The ink-jet recording material according to claim 1, wherein the layer containing the fumed silica further contains a cationic polymer.

11. The ink-jet recording material according to claim 1, wherein the layer containing the fumed silica contains a hydrophilic binder in an amount of 10 to 40% by weight based on the amount of the fumed silica.

12. The ink-jet recording material according to claim 11, wherein the hydrophilic binder is polyvinyl alcohol.

13. The ink-jet recording material according to claim 1, wherein the support is a water resistant support.

14. The ink-jet recording material according to claim 1, wherein a ratio of the fumed silica contained in the layer mainly containing the fumed silica is 60% by weight or more based on a total solid component.

15. The ink-jet recording material according to claim 1, wherein the layer mainly containing the fumed silica contains 5 to 20 g/m$^2$ of fumed silica.

16. The ink-jet recording material according to claim 11, wherein the layer mainly containing the fumed silica contains a cross-linking agent of the hydrophilic binder.

17. The ink-jet recording material according to claim 11, wherein the layer mainly containing the fumed silica contains a polyvinyl alcohol as the hydrophilic binder and glyoxal, boric acid or borax as a cross-linking agent.

18. The ink-jet recording material according to claim 1, wherein an average particle size of the polymer latex or the resin emulsion is 0.01 to 5.0 $\mu$m.

* * * * *